US007757870B2

(12) United States Patent
Lin et al.

(10) Patent No.: US 7,757,870 B2
(45) Date of Patent: Jul. 20, 2010

(54) RACK APPARATUS FOR TREATMENT PROCESSES

(75) Inventors: Chih-Pen Lin, Taipei Hsien (TW); Zheng-Gang Xie, Shenzhen (CN); Guo-You Xiong, Shenzhen (CN); Xian-Feng Luo, Shenzhen (CN); Hua-Jie Zheng, Shenzhen (CN); Zhi-Min Li, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 389 days.

(21) Appl. No.: 11/777,148

(22) Filed: Jul. 12, 2007

(65) Prior Publication Data

US 2008/0156757 A1 Jul. 3, 2008

(30) Foreign Application Priority Data

Dec. 29, 2006 (CN) ..... 2006 1 0064620

(51) Int. Cl.
*A47F 5/08* (2006.01)

(52) U.S. Cl. ..... 211/118; 211/182

(58) Field of Classification Search ..... 211/118, 211/181.1, 85.3, 45, 46, 38, 35, 182, 194, 211/188, 195, 119; 248/121, 150, 151, 165, 248/317, 323, 326, 339
See application file for complete search history.

(56) References Cited

U.S. PATENT DOCUMENTS 1,054,271 A * 2/1913 Boyer ..... 211/195
2,529,267 A * 11/1950 Sloane ..... 220/6
2,919,818 A * 1/1960 Clegg et al. ..... 211/195
4,901,867 A * 2/1990 Petty, Jr. ..... 211/46
4,921,098 A * 5/1990 Combier et al. ..... 206/408
5,111,941 A * 5/1992 Hillestad ..... 211/46
5,257,794 A * 11/1993 Nakamura ..... 280/79.3
5,570,792 A * 11/1996 Huang ..... 211/46
5,743,412 A * 4/1998 Noble ..... 211/59.2
6,027,000 A * 2/2000 Sterzel et al. ..... 224/42.33
6,085,640 A * 7/2000 King ..... 99/407
6,168,031 B1 * 1/2001 Schmidt ..... 211/46
6,286,691 B1 * 9/2001 Oberhaus et al. ..... 211/118
6,308,842 B1 * 10/2001 Robbins et al. ..... 211/113
6,508,376 B1 * 1/2003 Chiang ..... 220/485
6,766,730 B2 * 7/2004 Wrenn ..... 99/345
7,210,659 B2 * 5/2007 Lawson et al. ..... 248/95
7,500,574 B1 * 3/2009 Miller et al. ..... 211/106
2004/0007549 A1 * 1/2004 Klein et al. ..... 211/118
2004/0134867 A1 * 7/2004 Kin et al. ..... 211/45
2006/0186071 A1 * 8/2006 Rowan et al. ..... 211/113
2007/0163974 A1 * 7/2007 Lai ..... 211/85.3
2008/0023418 A1 * 1/2008 Robbins ..... 211/45
2008/0116160 A1 * 5/2008 McNicholas ..... 211/118
2008/0217272 A1 * 9/2008 Lam ..... 211/118

* cited by examiner

*Primary Examiner*—Jennifer E. Novosad
(74) *Attorney, Agent, or Firm*—Jeffrey T. Knapp

(57) ABSTRACT

A rack apparatus (100) for facilitating workpiece treatment includes a frame member (20) and a plurality of rack members (30). The rack members are detachably mounted on the frame member, wherein each rack member, in turn, includes a plurality of rack poles (305) that are detachably mounted thereon. When workpieces of large dimension or complicated shape require hanging/mounting on the rack apparatus, some rack poles and rack members can be disassembled, and thus the rack apparatus can provide more space to contain/carry these workpieces.

13 Claims, 4 Drawing Sheets

RACK APPARATUS FOR TREATMENT PROCESSES

BACKGROUND OF THE INVENTION

1. Field of the Invention

The present invention relates to a rack apparatus, and, particularly, to a rack apparatus used to hang workpieces during operating/treating processes, such as plating, washing, coloring, etc.

2. Description of Related Art

Rack apparatuses are widely used to hang/carry workpieces during operating/treating processes such as plating, washing, coloring, etc. Generally, a typical rack apparatus has a special shape and dimension that can be only used in one kind of operating process, and the typical rack apparatus can only hang/carry workpieces having special shapes and dimensions for which the rack apparatus was particularly designed to accommodate.

Therefore, when workpieces requiring a plurality of operating processes are processed, typically, a plurality of kinds/configurations of rack apparatuses are used in an operating line, wherein each kind of rack apparatus corresponds to a kind of operating process and/or a particular workpiece to be carried thereby. The workpieces are hung onto different kinds of rack apparatuses to be processed, in order. At the end of each operating process, the workpieces are taken off the rack apparatuses and hung on other rack apparatuses for the next process. Thus a great deal of time and work is generally consumed in the aforementioned operation. Additionally, when workpieces having shapes and dimensions that do not match the rack apparatuses installed on the operating line are manufactured and/or treated, all rack apparatuses must be replaced by new rack apparatuses that match these workpieces. In this way, the cost of this kind of processing may be made prohibitively expensive.

Therefore, an improved rack apparatus is desired in order to overcome the above-described shortcomings.

SUMMARY

A rack apparatus includes a frame member and a plurality of rack members. The rack members are detachably mounted on the frame member, and each rack member includes a plurality of rack poles detachably mounted thereto.

Other advantages and novel features will become more apparent from the following detailed description when taken in conjunction with the accompanying drawings.

BRIEF DESCRIPTION OF THE DRAWINGS

Many aspects of the present rack apparatus can be better understood with reference to the following drawings. The components in the drawings are not necessarily drawn to scale, the emphasis instead being placed upon clearly illustrating the principles of the present rack apparatus. Moreover, in the drawings, like reference numerals designate corresponding parts through out the several views.

DETAILED DESCRIPTION OF THE INVENTION

Figure 1:
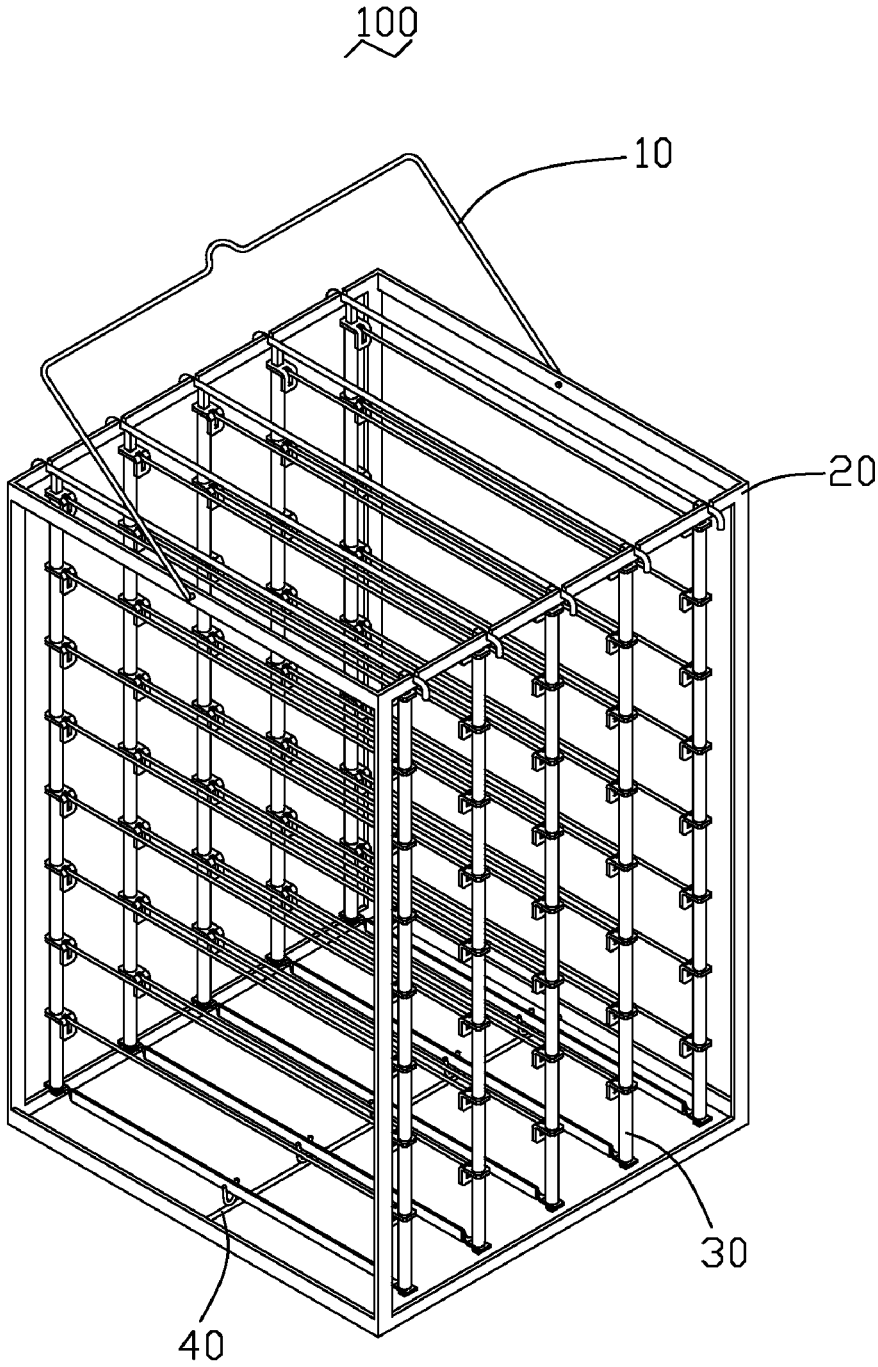
FIG. 1 is an assembled view of a rack apparatus, in accordance with a present embodiment.
Figure 2:
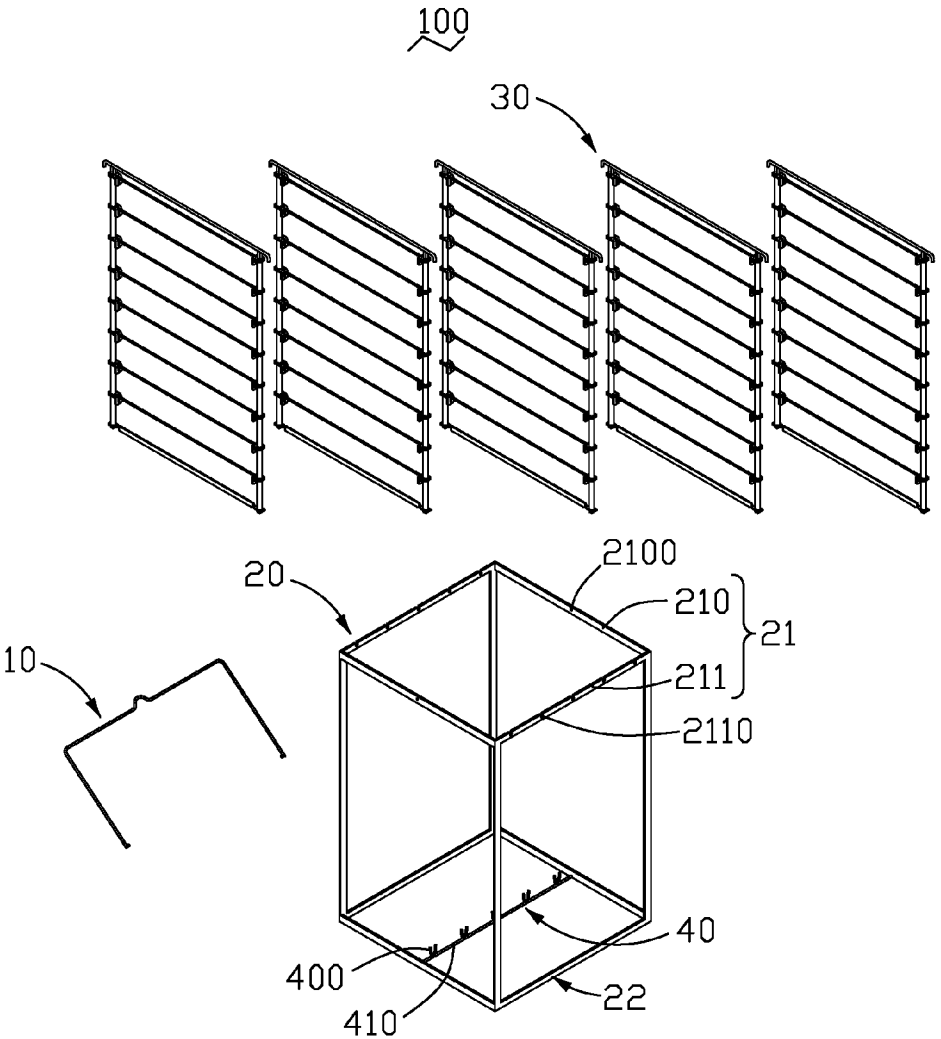
FIG. 2 is a disassembled view of the rack apparatus shown in FIG. 1.

Referring now to the drawings in detail, FIG. 1 and FIG. 2 show a rack apparatus 100, in accordance with a present embodiment. The rack apparatus 100 includes a hanging member 10, a frame member 20, a plurality of rack members 30 and a holding member 40. The hanging member 10 is mounted directly to/on a top of the frame member 20. The rack members 30 are detachably mounted on the frame member 20. The holding member 40 is mounted on a bottom of the frame member 20 to hold the rack members 30 in a desired position/orientation during at least one given processing step.

The hanging member 10 is an approximately U-shaped metal pole with two approximately parallel arm portions, and two respective distal ends of the arm portions of the hanging member 10 extend towards each other. The arm portions of the hanging member display a spring/elastic quality, which helps facilitate a selectably detachable mounting of the hanging member to the frame member 20. The frame member 20 is advantageously made of a mechanically and chemically durable metal, such as a stainless steel or titanium alloy. The frame member 20 is usefully cubical or rectangular parallelepiped in shape and, to attain such a shape, is formed from twelve metal poles via welding or bolting together. Of course, if another frame shape should be desired, the number of poles could be adjusted. Also, the number of poles could, potentially, be increased if reinforcement is desired, even if a cubical or parallelepiped shape is employed. The frame member 20 includes a rectangular top frame 21 and a rectangular bottom frame 22, parallel to the top frame 21. The top frame 21 is formed by two parallel hanging poles 210 and two parallel fixing poles 211, perpendicular to the hanging poles 210. Each hanging pole 210 defines a hanging hole 2100 in its middle portion, and a diameter of the hanging hole 2100 is larger than a width of each end of the hanging member 10. Each distal end of the hanging member 10 respectively is slidably received in a corresponding hanging hole 2100. Due to the spring quality of the hanging member 10, the distal ends of the hanging member 10 are effectively retained in the hanging holes 2100. Each fixing pole 211 defines a plurality of fixing apertures 2110 therein to allow assembly/mounting of the rack members 30, and the fixing apertures 2110 are, beneficially, arranged equidistantly. It is, however, understood that such apertures 2110 could be arranged in some other configuration (i.e., non-equidistant spacing).

Figure 3:
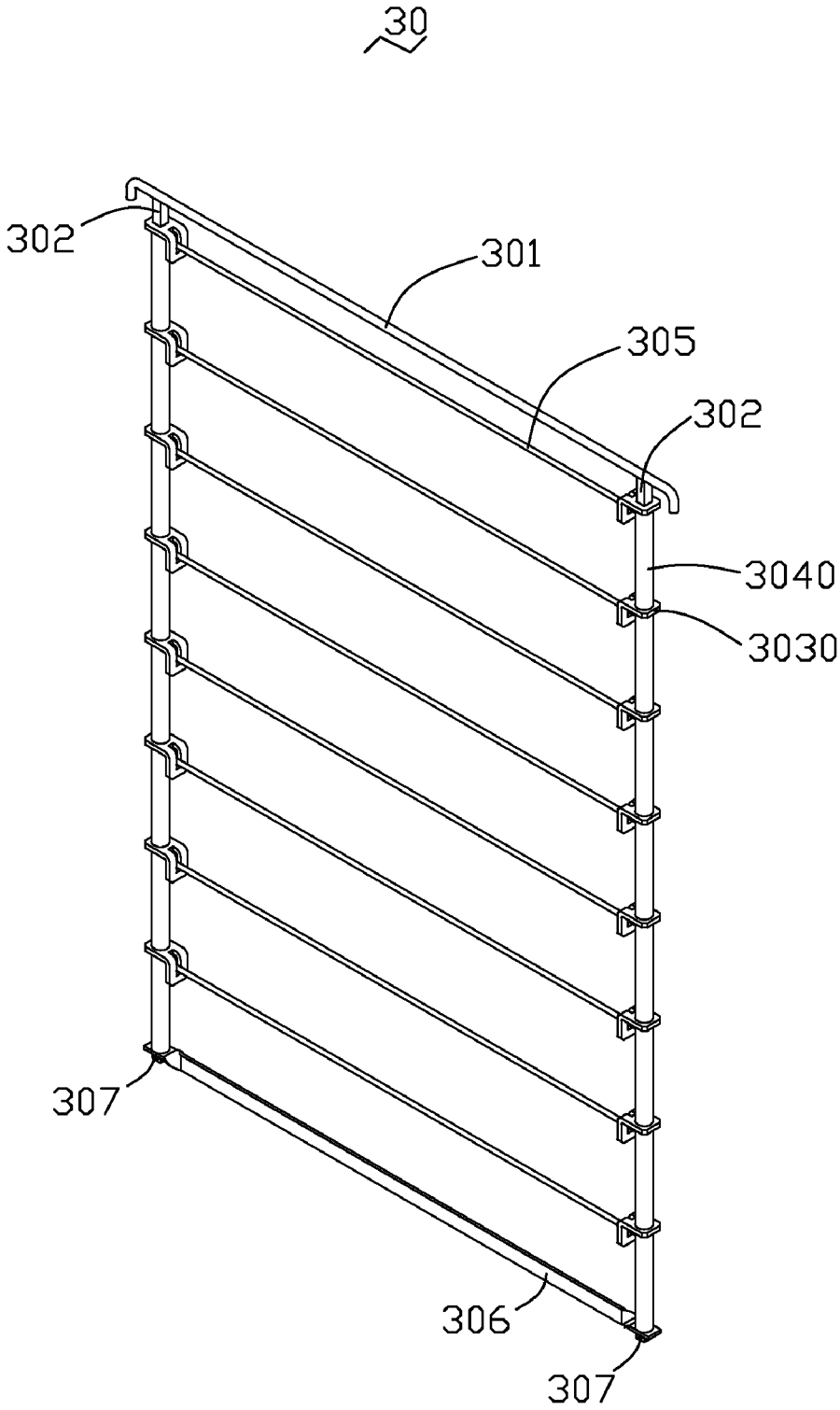
FIG. 3 is an assembled view of a rack member of the rack apparatus shown in FIG. 1.
Figure 4:
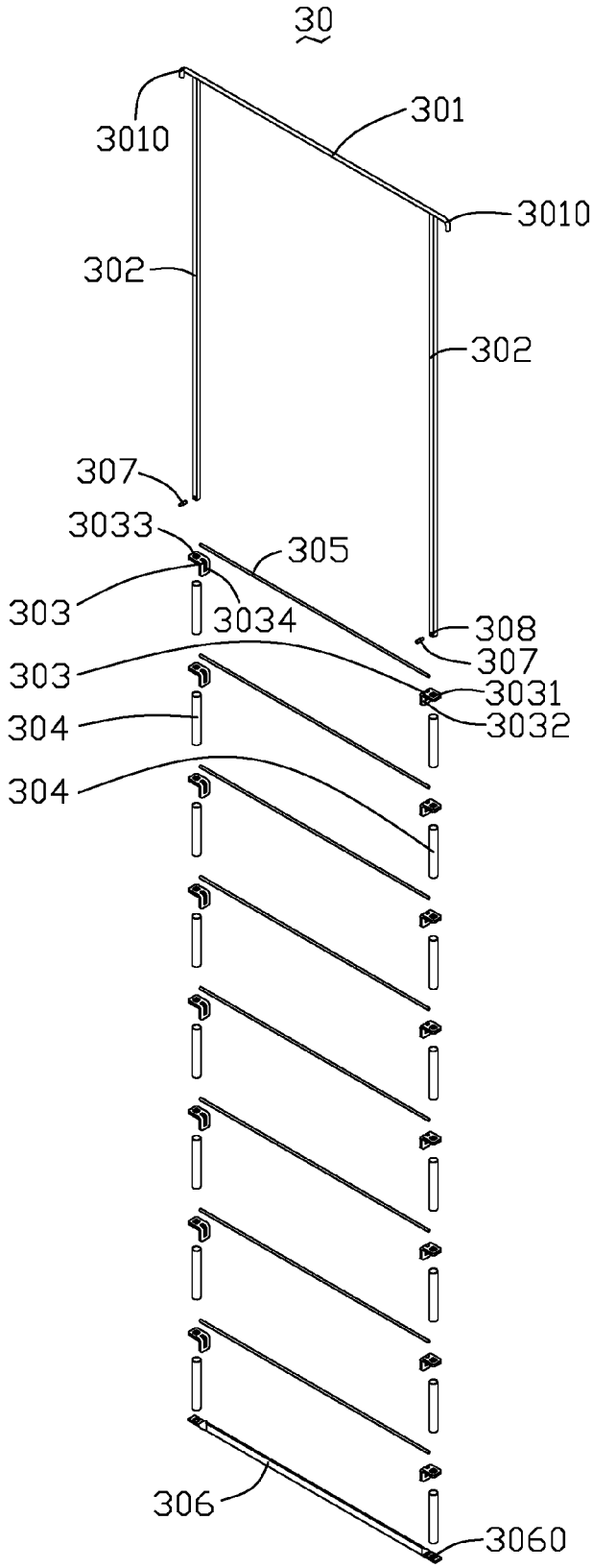
FIG. 4 is a disassembled view of the rack member shown in FIG. 3.

Also referring to FIG. 3 and FIG. 4, the rack members 30 are, advantageously, made of a durable (i.e., both mechanically and chemically) metal, such as stainless steel or titanium alloy. Each rack member 30 beneficially includes, at least, a top pole 301, two supporting poles 302, a plurality of fixing components 303, a plurality of spacing pipes 304, a plurality of rack poles 305, a bottom pole 306, and two holding bolts 307. Each end portion of the top pole 301 extends co-directionally with the other end portion thereof and approximately perpendicular to a main portion of the top pole 301. Thus, two connecting hooks 3010 are formed on the two ends of the top pole 301, each such connecting hook 3010 downwardly alongside yet spaced from the rack member 30. A width of each connecting hook 3010 is, usefully, slightly smaller that that of each fixing aperture 2110 to facilitate a sliding fit therebetween. That is, a detachable fit is desired therebetween, but an accidental disassembly of such during processing would best be avoided. These parameters help dictate the type of fit desired here. Each supporting pole 302 further defines a screw hole 308 in at least an end thereof to which the bottom pole 306 is to be affixed.

The holding member 40 is made of a durable metal (i.e., both mechanically and chemically), such as a stainless steel or titanium alloy. The holding member 40 opportunely includes, at least, a plurality of holding components 400 and a holding pole 410. The holding components 400 are, beneficially, semicircular loops mounted on the holding pole 410 via, e.g., welding or casting for holding the rack members 30 in their proper positions. Such semicircular loops are directed to open upwardly toward a top of the frame member 20. By having the holding components 400 be such upwardly-directed semicircular loops, such loops are able to matingly receive a corresponding bottom bar 306 of a respective rack member 30 therein, as each bottom bar 306 is primarily cylindrical, except at the ends thereof.

Each fixing component 303 is formed by a bent/angled metal piece (e.g., about a 90° bend), again formed of a durable metal as per the other components of the rack apparatus 100. The fixing component 303 usefully includes, at least, a connecting portion 3031 and a rack portion 3032, approximately perpendicularly connected (e.g., integrally) to the connecting portion 3031. The connecting portion 3031 defines a connecting hole 3033 therein, and a diameter of the connecting hole 3033 is larger than that of the supporting pole 302 to facilitate, advantageously, a slidable connection therewith. The rack portion 3032 defines a rack aperture 3034 therein, and a width of the rack aperture 3034 is larger than a diameter of the rack pole 305. The width of the rack aperture 3034 and the diameter of the rack pole 305 are advantageously chosen to yield a slide fit therebetween. An inner diameter of each spacing pipe 304 is larger than a diameter of the supporting pole 302, and an outer diameter of the spacing pipe 304 is larger than a diameter of the connecting hole 3033, thereby promoting a slide fit between such parts, also. A length of each rack pole 305 is approximately equal to that of the supporting pole 302. The bottom pole 306 defines two mounting holes 3060, respectively, in its two corresponding ends, and a diameter of the mounting hole 3060 is larger than that of the supporting pole 302 in a manner promoting, usefully, an appropriate slide fit.

In assembly, the holding pole 410 is mounted on a middle portion of the bottom frame 22 and parallel to the fixing poles 211, via, e.g., welding or bolting. The two supporting pole 302 are approximately perpendicularly connected to the top pole 301, for example, via welding or bolting. The ends defining the screw holes 308 of the supporting poles 302, respectively, extend approximately along a same direction as that of the connecting hooks 3010, and the connected ends of the two supporting poles 302 are each positioned near their respective connecting hook 3010. Each supporting pole 302 is, respectively, inserted into a connecting hole 3033 of a fixing component 303. Each supporting pole 302 is then, respectively, inserted into a spacing pipe 304. The aforementioned assembly operations can be repeated, in this way, and the fixing components 303 and the spacing pipes 304 are alternately mounted on/along the supporting poles 302, and the rack portions 3032 are oriented approximately perpendicular to the top pole 301.

The end of each supporting pole 302 is respectively inserted into a mounting hole 3060 of the bottom pole 306, and each of the holding bolts 307 is respectively screwed into a screw hole 308 of the supporting pole 302 to hold the supporting poles 302 in the mounting holes 3060. Two ends of each rack pole 305 are inserted into two respective rack apertures 3034 of two corresponding fixing components 303 mounted on the two supporting poles 302. In this way, a plurality of rack poles 305 are detachably and equidistantly mounted in parallel between the two supporting poles 302. Further, the supporting poles 302 are inserted into both the fixing components 303 and the spacing pipes 304. Resultingly, a rack member 30 is assembled. Additionally, the fixing components 303 can also be welded to the spacing pipes 304 in alternating fashion.

After a rack member 30 is assembled, the two connecting hooks 3010 of its top pole 301 are respectively placed into two corresponding fixing apertures 2110 of the frame member 20. The bottom poles 306 are placed into the holding components 400 to hold the rack member 30. In this way, a plurality of rack members 30 are equidistantly mounted in parallel on the frame member 20. Alternatively, the bottom frame 22 can define a plurality of holding apertures corresponding to the fixing apertures 2110 therein, and two ends of the bottom pole 306 can be placed into the holding apertures. In this way, the holding member 40 can, potentially, be omitted. Finally, the two ends of the hanging member 10 are respectively inserted into the two hanging holes 2100, and thus the rack apparatus 100 can be used in manufacturing.

In use, workpieces (not shown) are hung/mounted on the rack poles 305. Understandably, the rack poles 305 and the rack members 30 can be disassembled from the rack apparatus 100 and mounted to the rack apparatus 100 again, if required. Therefore, when workpieces of a large dimension or complicated shape require hanging on the rack apparatus 100, some rack poles 305 and rack members 30 can be disassembled, and thus the rack apparatus 100 can provide more space to contain these workpieces. Additionally, disassembling and mounting the rack poles 305 and the rack members 30 can also change the shape of the rack apparatus 100, according to requirement. In this way, the rack apparatus 100 can be installed on the operating/processing line without being replaced, and the workpieces hung on the rack apparatus 100 do not necessarily require taking off (i.e., removal from) the apparatus 100 until processing is complete. It is to be understood that the rack apparatus 100 could be used, e.g., to accommodate/carry workpieces that hang alongside a given rack member 30 and/or that lay across a plurality of rack poles 305 of adjacent/adjoining rack members 30. The rack apparatus 100, as such, is not to be prejudiced by the manner that a user could choose to hold/carry workpieces therewith.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A rack apparatus, comprising:

a frame member including a top frame and a bottom frame parallel to the top frame, a plurality of rack members detachably mounted on the frame member, wherein each rack member includes two supporting poles and a plurality of rack poles detachably mounted on the supporting poles; and a hanging member mounted on the frame member, the hanging member being an approximately U-shaped metal pole including two arm portions, the two arm portions defining two respective arm ends, the arm ends extending towards each other the top frame defining a pair of hanging holes, the two arm ends are each inserted into a respective hanging hole.

2. The rack apparatus as claimed in claim 1, wherein the frame member is at least one of a cube and a rectangular parallelogram in shape.

3. The rack apparatus as claimed in claim 1, wherein the top frame includes two hanging poles and two fixing poles, each hanging pole defines one of the pair of hanging holes therein, and each fixing pole defines a plurality of fixing apertures therein.

4. The rack apparatus as claimed in claim 3, wherein the rack member includes a top pole with a main pole portion and two end pole portions, each end pole portion extends in an essentially same end direction, the end direction of each end pole portion is approximately perpendicular to the main pole portion, and a connecting book is respectively formed at each end of the top pole.

5. The rack apparatus as claimed in claim 4, wherein each of the two connecting hooks is respectively placed into a corresponding fixing aperture of the frame member.

6. The rack apparatus as claimed in 4, wherein the two supporting poles are connected approximately perpendicular to the top pole, each supporting, pole thereby respectively defining a connected end connected to the top pole; the supporting poles respectively extend along a direction identical to that of the connecting hooks, and the two supporting poles are respectively positioned near a corresponding connecting hook.

7. The rack apparatus as claimed in claim 6, wherein the rack member includes a plurality of fixing components mounted on the supporting poles, each fixing component including a connecting portion and a rack portion connected approximately perpendicularly to the connecting portion.

8. The rack apparatus as claimed in claim 7, wherein each connecting portion defines a connecting hole therein, a supporting pole being inserted into the connecting hole to mount the fixing component on the supporting pole.

9. The rack apparatus as claimed in claim 8, wherein the rack member includes a plurality of spacing pipes, the fixing components and the spacing pipes are alternately mounted along the supporting poles, and the rack portions are mounted approximately perpendicular to the top pole.

10. The rack apparatus as claimed in claim 9, wherein each rack portion defines a rack aperture therein, two ends of each rack pole are respectively inserted into two corresponding rack apertures of two corresponding fixing components respectively mounted on the two supporting poles.

11. The rack apparatus as claimed in claim 10, wherein the rack member includes a bottom pole, the bottom pole defines two mounting holes in the two respective ends thereof; each supporting pole has an extended end opposite to the connected end thereof, the extended end of each supporting pole is respectively inserted into a corresponding mounting hole, and the supporting poles are thereby held in the bottom pole.

12. The rack apparatus as claimed in claim 11, wherein the rack apparatus includes a holding member, the holding member includes a plurality of holding components and a holding pole, the holding components arc mounted on the holding pole, and the holding pole is mounted on the bottom frame.

13. The rack apparatus as claimed in claim 12, wherein the bottom poles are placed in the holding components.

* * * * *